United States Patent [19]

Vacher

[11] Patent Number: 4,519,329

[45] Date of Patent: May 28, 1985

[54] BOGIE WITH ORIENTABLE AXLES FOR RAILROAD VEHICLES

[75] Inventor: Pierre Vacher, Paris, France

[73] Assignee: A.N.F. Industrie, France

[21] Appl. No.: 516,953

[22] Filed: Jul. 25, 1983

[30] Foreign Application Priority Data

Jul. 26, 1982 [FR] France ..... 82 12992

[51] Int. Cl.[3] ..... B61F 5/30

[52] U.S. Cl. ..... 105/218 A; 91/44; 105/168

[58] Field of Search ..... 91/44; 105/218 A, 218 R, 105/223, 3, 4, 224 A, 224 R, 164–170; 92/24, 27, 28; 180/167, 285, 139, 136, 81 A, 6.3, 6.6, 181; 104/247; 298/35 M

[56] References Cited

U.S. PATENT DOCUMENTS

| | | | |
|---|---|---|---|
| 2,237,299 | 4/1941 | Benbow et al. | 298/35 M |
| 2,908,251 | 11/1959 | Gratzmuller | 91/44 |
| 4,099,669 | 7/1978 | Cortopassi | 180/167 X |
| 4,135,456 | 1/1979 | Welsh | 105/168 X |
| 4,233,910 | 11/1980 | Schumacher | 105/168 X |
| 4,440,094 | 4/1984 | Levy | 105/168 X |

*Primary Examiner*—Robert B. Reeves
*Assistant Examiner*—Glenn B. Foster
*Attorney, Agent, or Firm*—Cantor and Lessler

[57] ABSTRACT

The bogie of a railroad vehicle, in particular for city transportation, is provided with axles which can be oriented substantially along the radius of the curves of a railroad track. The primary suspension of the bogie comprises springs and guiding link-arms of variable length constituted by hydraulic jacks for modifying the angle of the axle with respect to the bogie frame according to the radius of the curve being negotiated.

18 Claims, 4 Drawing Figures

BOGIE WITH ORIENTABLE AXLES FOR RAILROAD VEHICLES

This invention relates to a bogie for railroad vehicles and especially for city railroad vehicles.

In a conventional two-axle bogie, the distance between the two axles, or wheel-base, is usually within the approximate range of 1.80 m to 2.30 m. When a vehicle equipped with a bogie of this type passes through short-radius curves of the order of 100 to 300 meters, for example, the two axles are located in an angular position with respect to the track which is far from the ideal radial position. This gives rise to substantial friction and grinding which in turn result in appreciable wear of the wheel flanges and rails. In the case of railroad tracks for city transportation systems, the radius of curves may be as short as 30 meters, thus further increasing the disadvantages just mentioned.

It has already been proposed to provide bogies in which each axle is mounted so as to be capable of pivotal displacement about a vertical axis with respect to the bogie frame so that, when negotiating a curve, each axle is capable of assuming an orientation substantially along the radius of the curve traversed by the bogie.

On these pivotal-axle bogies, each axle could be mounted for free pivotal displacement, in which case it would have to be capable of self-orientation by reaction of the wheels on the curved track. In an alternative arrangement, each axle could be coupled mechanically to the vehicle body by means of a link-rod system so designed as to orient the axle as a function of the angle of pivotal displacement of the bogie frame with respect to the vehicle body during negotiation of curves.

However, these solutions have not given rise to any practical development. This is due in the first place to the complication involved in the construction of the bogie in order to provide pivoted axles and in the second place to the difficulties experienced in controlling the orientation of the axles above a given speed. This is liable to result in yawing movements which produce a harmful effect on the axles and on the bogie as a whole.

The object of the present invention is to overcome these disadvantages and to permit the construction of a bogie having orientable axles which is of simple construction, which obtains a suitable orientation of the axles in curves, and which affords the same resistance to yawing movements as a fixed-axle bogie.

The invention relates to a bogie of the type comprising a bogie frame and two axles coupled to the frame by means of resilient primary suspension elements and by means of substantially horizontal guiding link-arms, one end of each link-arm being pivotally attached to the bogie frame and the other end being attached to one axle-box. In accordance with the invention, at least one link-arm of each axle is a variable-length controlled telescopic arm constituted by a double-acting hydraulic jack. One of the jack elements such as the jack cylinder or the jack piston which divides the cylinder into two chambers is coupled to the bogie frame whilst the other jack element is coupled to the axle-box. A hydraulic circuit comprising a switching device selectively establishes the supply, draining and isolation of the two jack chambers. Control means which come into action in response to the curves of the track on which the bogie is running have the function of actuating the aforementioned switching device. A releasable locking mechanism is provided for locking each jack in its mean position corresponding to the position of the axles at right angles to the longitudinal axis of the bogie.

In a preferred embodiment and in the case of one and the same axle, each axle-box is attached to the bogie frame by means of a telescopic link-arm having a controlled length, one of the link-arms being subjected to a movement of extension whilst the other link-arm is subjected to a movement of compression, or conversely.

It is already apparent from the foregoing that a bogie of this type is of simple construction since the pivotal displacement takes place about an imaginary vertical axis and there is accordingly no need to provide the axle with a real pivot-pin.

The control means mentioned above can comprise ground beacons which transmit to the switching devices carried by the bogie information relating to the direction and radius of the curve on which the vehicle is engaged.

By way of alternative, said control means can comprise means for detecting the orientation of the bogie with respect to the vehicle body. The information delivered by said detecting means is transmitted to the switching devices in order to produce a change in length of the hydraulic link-arms or in other words a change in position of the axle-boxes.

Irrespective of the orientation assumed by the axles with respect to the bogie frame, the rigidity of said orientation is always ensured by the hydraulic means provided by the jacks. The same degree of rigidity is also provided in the position of the axles at right angles to the longitudinal axis of the bogie. This condition is ensured by the locking mechanism which locks said jacks in the mean position as long as no information indicating a curve has been received. A bogie constructed in accordance with this design has the same characteristics of resistance to yawing movements as a conventional bogie with fixed axles.

Other features of the invention will be more apparent upon consideration of the following description and accompanying drawings, wherein.

Figure 1:
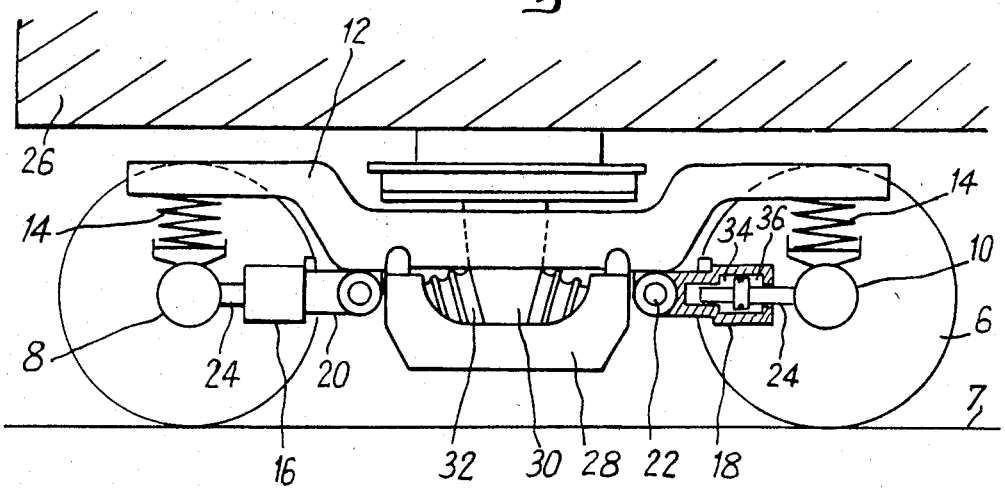
FIG. 1 is a side view of a bogie in accordance with the invention.
Figure 2:
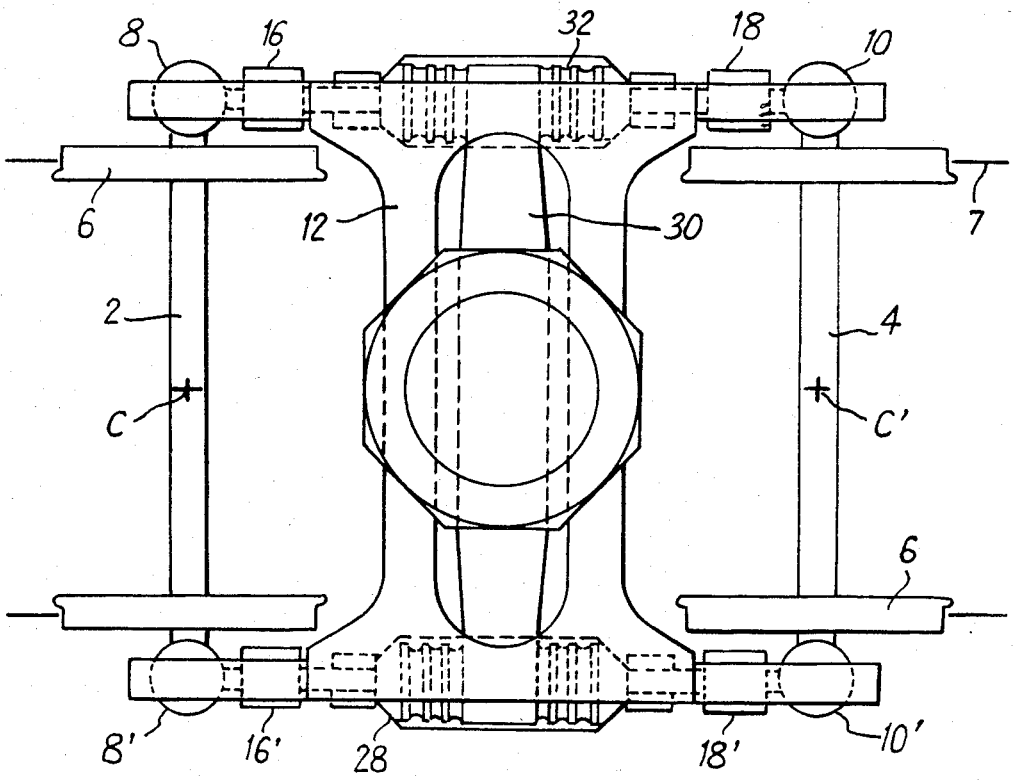
FIG. 2 is a plan view of the same bogie.

The bogie shown in FIGS. 1 and 2 is of a known type which comprises a so-called "primary suspension with guiding link-arms".

The two axles 2, 4 carry wheels 6 which run along the track 7 and the ends of said axles are mounted in axle-boxes 8, 8', 10, 10'. The axle-boxes are connected to the bogie frame 12 by means of a primary suspension comprising resilient elements such as springs 14 and substantially horizontal "guiding link-arms" 16, 16', 18, 18'. One end 20 of each link-arm is pivotally mounted on the frame 12 by means of a rubber bushing 22 of the "silent-block" type and the other end 24 of each link-arm is attached to the corresponding axle-box 8, 8', 10, 10'. The link-arms ensure longitudinal and lateral bracing of the axles with respect to the bogie frame.

The secondary suspension between the bogie frame 12 and the vehicle body 26 can be of any suitable type and does not form part of the invention. There is shown by way of example in FIGS. 1 and 2 a secondary suspension 28 of the type comprising a cradle-rocker and bolster 30 with interposition of elastic assemblies 32. A secondary suspension of this type has been described in French Pat. No. 2,227,163 in the name of A. N. F. Frangeco.

In a conventional bogie of the so-called "guiding link-arm" type described in the foregoing, the link-arms are elements having a well-determined and fixed length.

In accordance with the present invention, the link-arms 16, 16', 18, 18' are of controlled variable length and are each constituted by a double-acting hydraulic jack as shown in cross-section in FIG. 1 in the case of the link-arm 18.

If either of the two chambers 34, 36 of the jacks 18 is supplied with fluid under pressure, the telescopic link-arm is subjected either to a movement of compression or to a movement of extension, thus varying the position of the corresponding axle-box 8, 10 with respect to the bogie frame 12.

Figure 3:
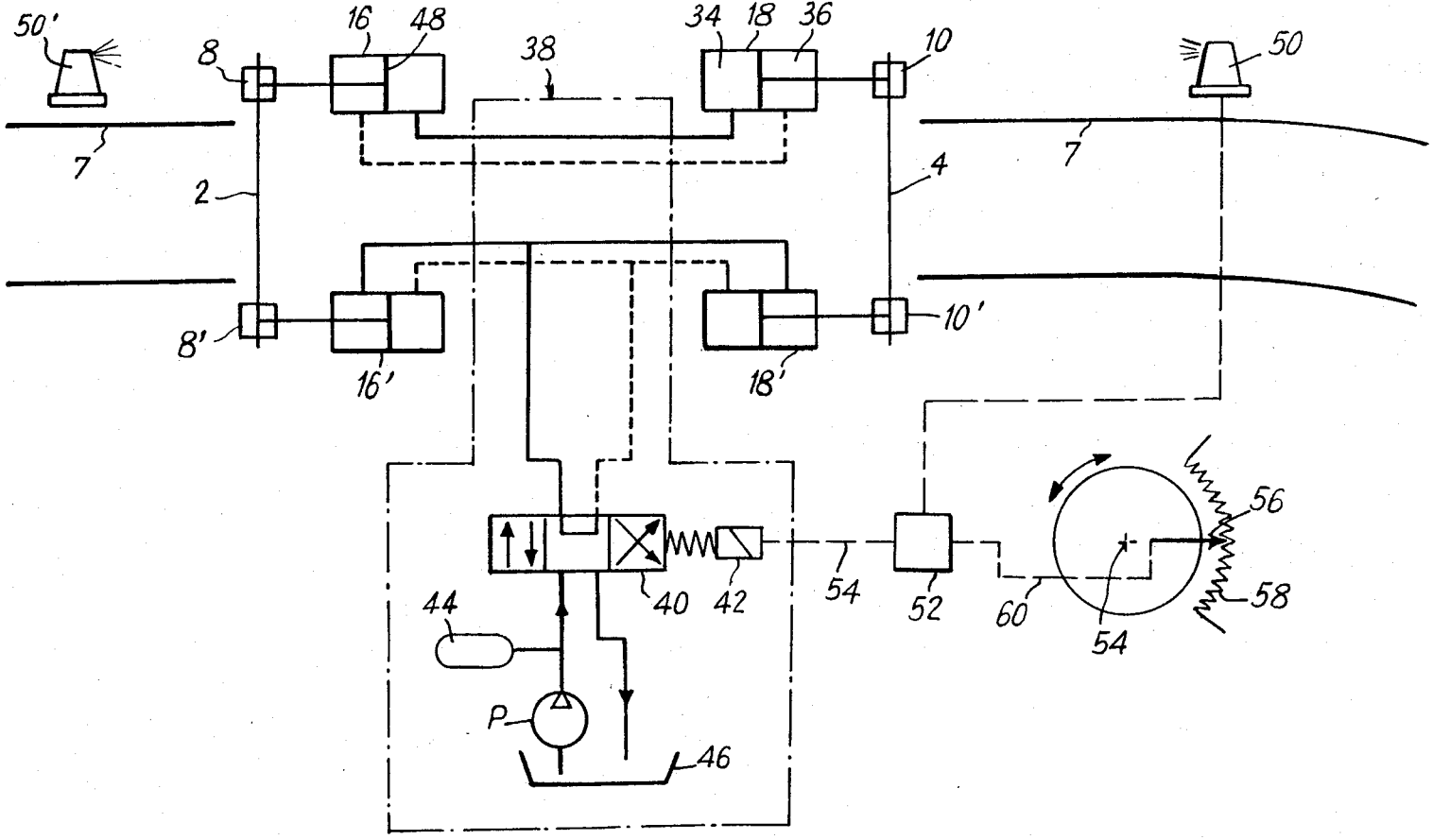
FIG. 3 is a simplified diagram of a hydraulic circuit for controlling the jacks.

Provision could be made on each axle for a single axle-box controlled by a telescopic link-arm whilst the other axle-box has a fixed position. But for reasons of symmetry and in order to limit the stroke of the jacks, it is preferable as shown in FIGS. 1, 2 and 3 to provide one telescopic link-arm on each side of the axle. It will be readily understood that, in the case of each axle, the two jacks (16, 16') or (18, 18') are supplied in opposite directions, with the result that one jack undergoes a movement of extension when the other jack undergoes a movement of compression. In consequence, the axles 2 and 4 are capable of pivoting respectively about imaginary vertical axes C—C' (FIG. 2) without entailing the need for real pivot-pins.

FIG. 3 is a simplified representation of a system for controlling the four telescopic link-arms of a bogie in accordance with the invention. This control system comprises a hydraulic circuit 38 which provides a suitable connection between the chambers 34, 36 of the jacks 16, 16', 18, 18' and which is controlled by a hydraulic switching device such as an electric slide-valve or three-position distributor 40 operated by an actuator 42. The hydraulic circuit 38 which is carried by the bogie frame comprises in the conventional manner a pump P, an accumulator 44 and a low-pressure reservoir 46 as well as the usual ancillary devices not shown in the drawings, such as manostats, safety valves, and so on.

The operation of said hydraulic circuit is sufficiently clear to require no comment other than the fact that, in the intermediate position of the valve 40 as shown, the chambers 34, 36 of the four jacks are isolated, thus locking the pistons 48 of the jacks hydraulically and maintaining the axles 2 and 4 in the orientation which they have assumed. When the slide of the electric valve 40 is displaced either to one side or to the other, the chambers 34, 36 of the jacks are either supplied with fluid under pressure or else drained, thus causing the pivotal displacement of the two axles 2 and 4 in opposite directions in order to orient said axles substantially along the radius of the curve which is being negotiated.

The actuator 42 of the valve 40 is dependent on control means which come into action in response to the curves of the track on which the bogie is running.

In a first embodiment, said control means can comprise beacons 50, 50' which are mounted on the ground in the vicinity of the track 7.

At the curve entrances, one or a number of beacons 50 emits a signal (such as, for example, an electromagnetic or high-frequency signal) which is representative of the radius of the curve and of its direction with respect to the direction of travel of the train.

Said signal is collected by a receiving and processing circuit 52 (shown in FIG. 3) which is carried by the bogie or the vehicle body. Said circuit 52 transmits via the connection **52*a* the control order which is necessary for causing the actuator 42 to bring the axles 2, 4 to the suitable orientation in dependence on the radius and direction of the curve. A sensor (not shown in the figures) for detecting the position of the axles (also omitted from the drawings) causes the valve 40** to return to the neutral position when the selected orientation is reached, in accordance with well-known practice in servocontrol techniques.

Before the exit of the curves, another beacon 50' is so arranged as to initiate the return of the axles 2 and 4 to a parallel position.

As will readily be apparent, beacons of this type need be provided only in the case of curves which have a short radius and are subject to abnormal wear.

In a second embodiment, the actuator 42 of the valve 40 can be operated from a device for permanent checking of the rotation of the bogie beneath the vehicle body 26.

In this case, provision is made for an angular position detecting system or pickup, one of the elements of which is carried by the pivot-pin 54 of the bogie and the other element of which is carried by the vehicle body 26.

By way of illustration, there is shown in FIG. 3 an angular displacement potentiometer pickup system, the moving element 56 of which is rigidly fixed to the center pin 54 of the bogie and the stationary element 58 of which is carried by the vehicle body. The voltage signal 56 is supplied via a line 60 to the receiving and processing circuit 52 which transmits the orders to the actuator 42 in order to bring the axles to the desired orientation.

It would clearly be possible to choose any standard type of detecting system such as a magnetic or capacitive transducer, for example. It is preferable to provide two or three detectors in order to ensure enhanced reliability of the device.

Figure 4:
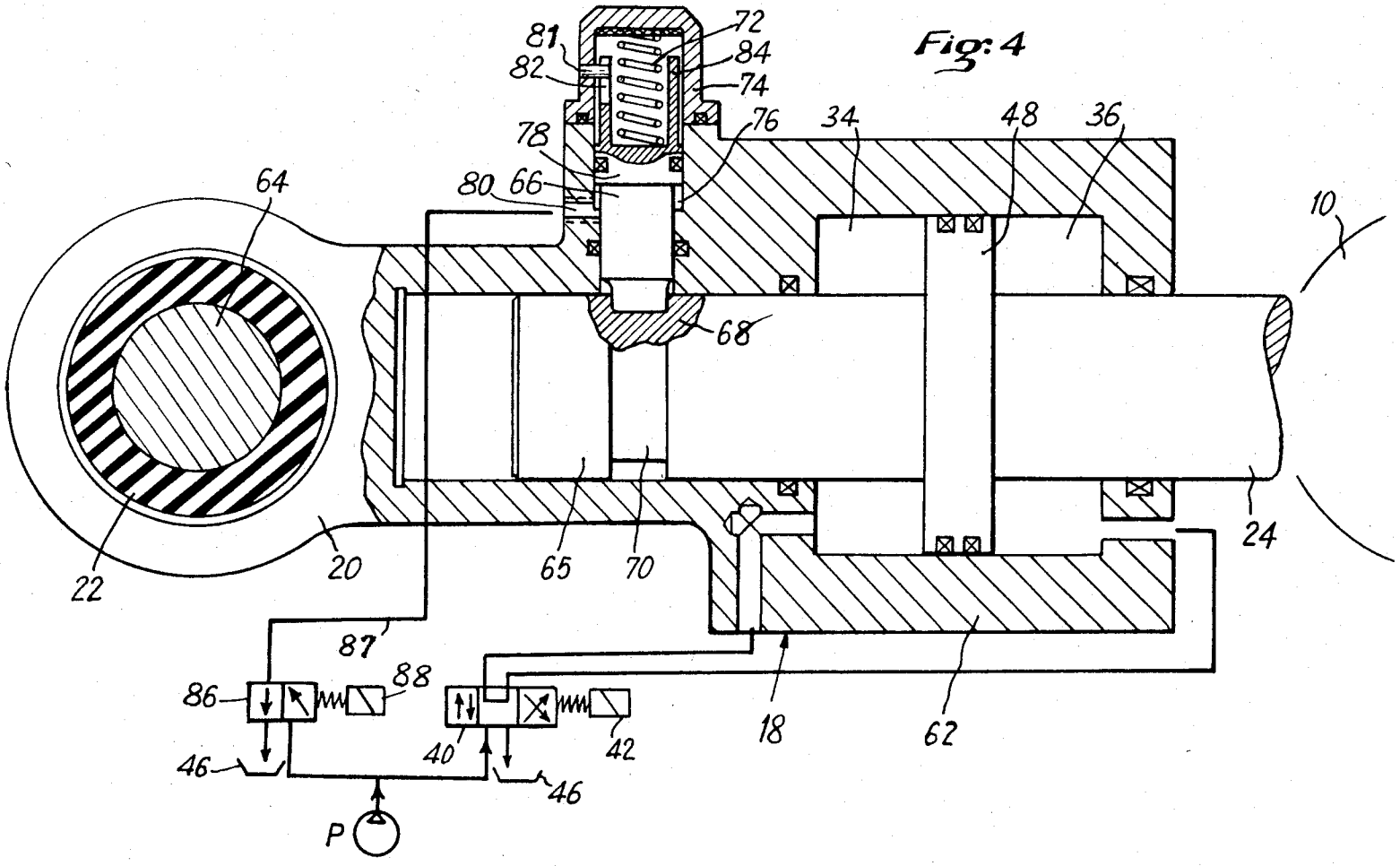
FIG. 4 is a longitudinal sectional view of a telescopic link-arm with a mechanism for locking in the mean position.

FIG. 4 is a diagram to a larger scale showing a double-acting hydraulic jack 18 which constitutes one of the guiding link-arms in a bogie in accordance with the invention. The end portion 20 of the jack cylinder 62 is pivotally mounted on a pin 64 which is rigidly fixed to the bogie frame 12 with interposition of a rubber bushing 22.

The emergent end of the operating rod 24 of the jack is secured to an axle-box 10. The operating rod 24 is guided at both ends, one end 65 being slidably mounted within the jack body in order to produce the same forces and the same speeds in both directions of displacement.

The jack is provided with a hydraulically releasable mechanical latch bolt which is intended to maintain the jack in its central position corresponding to the axle located at right angles to the longitudinal axis of the bogie.

Said latch bolt comprises a piston 66, one end 68 of said piston being capable of engaging within a groove 70 cut in the portion 65 of the jack-operating rod 24 and the other end of which is subjected to the action of a spring 72 which is retained in the cylinder body 62 by means of a cap 74.

The engagement of the end portion 68 of the piston within the groove 70 has the effect of locking the jack in position and preventing any displacement of the axle-boxes.

In order to unlock the system and to bring the jack to the operating position, the chamber 76 which is located beneath the larger-diameter portion 78 of the piston 66 need only be put under pressure via a port 80. This pressure exceeds the force exerted by the spring 72 and causes the withdrawal of the end portion 68 of the piston from the groove 70. Either the jack chamber 34 or the jack chamber 36 can then be supplied, depending on the direction of operation which is chosen.

In order to lock the jack in position, it is only necessary to release the pressure within the chamber 76, whereupon the spring 72 thrusts back the piston 66 against the operating-rod 24. When the jack piston 48 returns to its rest position, the end portion 68 of the latch bolt engages within the groove 70 when this latter comes into position immediately opposite to said end portion. Since the force required for the locking operation is produced by the spring 72, the oil contained within the chamber 76 is returned to the low-pressure reservoir under the action of the spring.

The end portion 68 of the latch bolt is preferably given a square shape in order to increase the surface which is in contact with the groove 70. In this case, rotational displacement of the latch bolt 66 is prevented by means of a stud 81 fixed within the cap 74 and capable of sliding within an elongated slot 82 formed in a skirt 84 which is located above the piston 66.

Pressurizing or draining of the latch-bolt chamber 76 can be controlled by a three-way distributor 86 having two positions and connected to the port 80 by means of a pipe 87 (as shown in FIG. 4). In the rest position shown, the distributor 86 connects the chamber 76 to the low pressure. The distributor 86 is displaced towards the "supply" position by an actuator 88 which is controlled by the receiving and processing circuit 52 (shown in FIG. 3) which also controls the distributor 40.

Said circuit 52 is so arranged that, at the beginning of a curve, the latch bolt is released only after a predetermined time delay since it serves no useful purpose to modify the orientation of the axles in long-radius portions of curves whereas it is necessary to prevent any increase in yawing movements which may be exhibited by the bogie as it enters the curve.

The circuit 52 is also arranged so as to ensure that, at the exit of a curve, the distributor 86 is restored to the rest position as soon as the angle of the bogie with respect to the vehicle body has become sufficiently small. Thus the latch bolt which is controlled by the spring 72 again locks the jacks in position as soon as the axles return to their parallel positions.

The device which has just been described offers complete safety by reason of the fact that absence of pressure (or absence of an electric signal for controlling the actuator 88) prevents any release of the jacks and that, in this state of operation, the bogie has fixed axles which cannot be oriented.

A further guarantee can be provided by two oppositely-acting compression springs or by pads of elastomer which tend to restore the jacks automatically to the mean position and consequently to bring the axles back to the parallel position in which they are automatically locked.

It will be understood that each of the two bogies of a vehicle is equipped with the device described in the foregoing. Only certain elements could be common to both bogies such as, for example, the pump P of the hydraulic circuit and possibly also the hydraulic accumulator 44.

As is readily apparent, the invention is not limited in any sense to the embodiments described by way of example with reference to the accompanying drawings. Depending on the applications which may be contemplated, consideration could be given to many alternative forms of construction within the capacity of those versed in the art without thereby departing either from the scope or the spirit of the invention.

What is claimed is:

1. A bogie for a railroad vehicle of the type comprising a bogie frame and two axles coupled to the frame by means of resilient primary suspension elements and by means of substantially horizontal link-arms, one end of each link-arm being pivotally attached to the bogie frame and the other end being attached to one axle-box, wherein at least one link-arm of each axle is a variable-length controlled telescopic arm constituted by a double-acting hydraulic jack, one of the jack elements such as the piston or cylinder being coupled to the bogie frame and the other jack element being coupled to the axle-box, wherein said bogie comprises a hydraulic circuit provided with switching means for selectively establishing the supply, draining and isolation of the two jack chambers, wherein said bogie comprises control means which come into action in response to the curves of the track on which the bogie is running, and wherein each hydraulic jack is provided with a releasable locking mechanism for locking said jack in the mean position.

2. A bogie according to claim 1, wherein each axle-box of one and the same axle is attached to the bogie frame by means of a controlled telescopic link-arm and wherein the switching means supply the two jacks of the same axle in opposite directions.

3. A bogie according to claim 1 or claim 1, wherein the aforementioned control means comprise ground beacons and a circuit for detecting and processing signals emitted by said beacons, the function of said circuit being to deliver in response a control order to the actuator of the switching device.

4. A bogie according to claim 3, wherein the locking mechanisms comprise a locking member which is continuously urged by a spring towards the locked position and which is unlocked by application of a hydraulic pressure.

5. A bogie according to claim 4, wherein pressurization of the locking mechanism is controlled by a hydraulic distributor of which the actuator is controlled by the aforementioned processing circuit as a function of the curvature of the track.

6. A bogie according to claim 5, wherein resilient means are provided for restoring the hydraulic jacks to their mean position in which the locking member is capable of locking the jack-operating rod.

7. A bogie according to claim 1, wherein the aforementioned control means comprise ground beacons and a circuit for detecting and processing signals emitted by said beacons, the function of said circuit being to deliver in response a control order to the actuator of the switching device.

8. A bogie according to claim 1, wherein the control means aforementioned comprise a position-detecting pickup for delivering a signal which is representative of the angular position of the bogie with respect to the vehicle body, and a circuit for processing said signal and delivering in response a control order to the actuator of the switching device.

9. A bogie according to claim 2, wherein the control means aforementioned comprise a position-detecting pickup for delivering a signal which is representative of the angular position of the bogie with respect to the vehicle body, and a circuit for processing said signal and delivering in response a control order to the actuator of the switching device.

10. A bogie according to claim 7, wherein the lobking mechanism comprise a locking member which is continuously urged by a spring towards the locked position and which is unlocked by application of a hydraulic pressure.

11. A bogie according to claim 8, wherein the locking mechanisms comprise a locking member which is continuously urged by a spring towards the locked position and which is unlocked by application of a hydraulic pressure.

12. A bogie according to claim 9, wherein the locking mechanisms comprise a locking member which is continuously urged by a spring towards the locked position and which is unlocked by application of a hydraulic pressure.

13. A bogie according to claim 10, wherein pressurization of the locking mechanism is controlled by a hydraulic distributor of which the actuator is controlled by the aforementioned processing circuit as a function of the curvature of the track.

14. A bogie according to claim 11, wherein pressurization of the locking mechanism is controlled by a hydraulic distributor of which the actuator is controlled by the aforementioned processing circuit as a function of the curvature of the track.

15. A bogie according to claim 12, wherein pressurization of the locking mechanism is controlled by a hydraulic distributor of which the actuator is controlled by the aforementioned processing circuit as a function of the curvature of the track.

16. A bogie according to claim 13, wherein resilient means are provided for restoring the hydraulic jacks to their means position in which the locking member is capable of locking the jack-operating rod.

17. A bogie according to claim 14, wherein resilient means are provided for restoring the hydraulic jacks to their mean position in which the locking member is capable of locking the jack-operating rod.

18. A bogie according to claim 15, wherein resilient means are provided for restoring the hydraulic jacks to their mean position in which the locking member is capable of locking the jack-operating rod.

* * * * *